US005629266A

United States Patent [19]

Lithgow et al.

[11] Patent Number: 5,629,266

[45] Date of Patent: May 13, 1997

[54] ELECTROMAGNETIC RESONATOR COMPRISED OF ANNULAR RESONANT BODIES DISPOSED BETWEEN CONFINEMENT PLATES

[75] Inventors: Robert D. Lithgow, Schaumburg, Ill.; Eva Koh, Singapore, Singapore; Malcolm E. Lines, Millington; George E. Peterson, Warren, both of N.J.

[73] Assignees: Lucent Technologies Inc., Murray Hill, N.J.; Illinois Superconductor Corporation, Mt. Prospect, Ill.

[21] Appl. No.: 348,636

[22] Filed: Dec. 2, 1994

[51] Int. Cl.[6] ..... H01P 1/201; H01P 7/00; H01B 12/06

[52] U.S. Cl. ..... 505/210; 333/202; 333/219; 333/99.005; 505/700; 505/866

[58] Field of Search ..... 333/995, 202, 333/219; 505/210, 700, 866

[56] References Cited

U.S. PATENT DOCUMENTS

| | | | |
|---|---|---|---|
| 4,742,320 | 5/1988 | Pfizenmaier et al. | 333/219 |
| 4,812,791 | 3/1989 | Makimoto et al. | 333/235 X |
| 4,996,188 | 2/1991 | Kommrusch | 333/202 X |
| 5,011,823 | 4/1991 | Jin et al. | 505/452 |
| 5,157,017 | 10/1992 | Jin et al. | 505/451 |
| 5,272,132 | 12/1993 | Gyorgy et al. | 505/930 |
| 5,324,713 | 6/1994 | Shen | 505/210 |
| 5,340,797 | 8/1994 | Hodge et al. | 505/470 |

FOREIGN PATENT DOCUMENTS

WO88/08622 11/1988 WIPO .

OTHER PUBLICATIONS

"The Superconducting Split Ring Resonator as an Accelerating Structure", by G. J. Dick et al., *Nuclear Instruments and Methods,* vol. 138, No. 2, 15 Oct. 1976, Amsterdam NL, pp. 203–207.

"Radio–Frequency Losses of $YBa_2Cu_3O_{7-\delta}$ Composite Superconductors", by Z. Wang et al., *Superconductor Science and Technology,* vol. 1, No. 1, Jan. 1988, Bristol GB, pp. 24–26.

"Split–ring Resonator for Use in Magnetic Resonance from 200–2000 MHz", by W. N. Hardy et al., *Review of Scientific Instruments,* vol. 52(2), p. 213 (1981).

"Loop–Gap Resonator: A Lumped Mode Microwave Resonant Structure", by M. Mehdizadeh et al., *IEEE Transactions on Microwave Theory and Techniques,* vol. MTT–31 (12), p. 1059 (1983).

"Strip–ring Resonator Makes Harmonics–rich Oscillator", by P. Jezek et al., *Microwaves & RF,* Jun. 1984, p. 132.

"Test of a $\beta \cong 0.1$ Superconducting Split Ring Resonator*", by J. R. Delayen et al., *IEEE Transactions on Magnetics,* vol. Mag–17, No. 1, Jan. 1981, p. 939.

"Handbook of Filter Synthesis", by A. I. Zverev, J. Wiley and Sons, Inc., New York, 1967.

*Primary Examiner*—Benny T. Lee
*Attorney, Agent, or Firm*—Eugen E. Pacher

[57] ABSTRACT

Electromagnetic resonators according to the invention comprise a first body, exemplarily a split thin ring, that is disposed between two planar field confining plates. The thickness (t) of the first body is less (typically less than ½ or 1/10) of the outer radius (R) of the body, and the distance between the first body and the confining plates is less than R. In preferred embodiments the first body comprises superconducting material. Resonators according to the invention can be readily assembled into relatively compact filters that are easily tunable, can have large quality factor, and offer the possibility of single mode operation. Such filters can advantageously be used in, e.g., wireless communications systems.

11 Claims, 7 Drawing Sheets

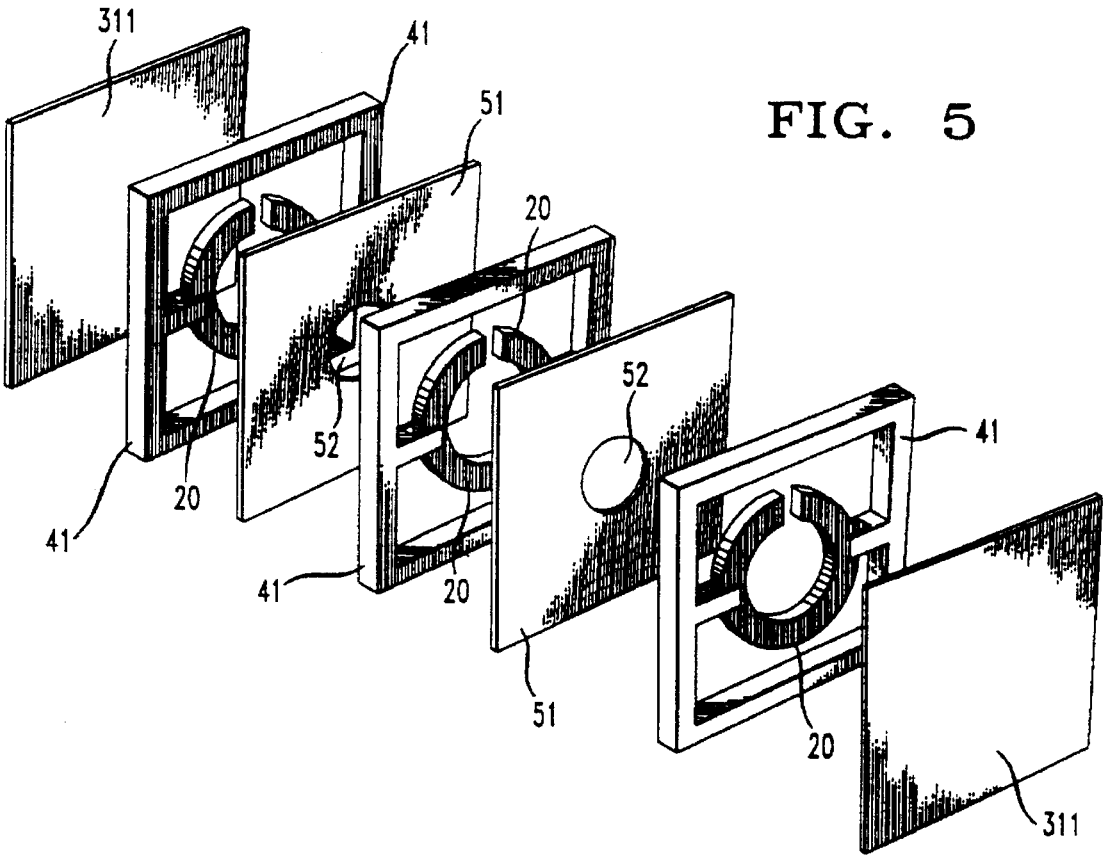
FIG. 5
FIG. 6
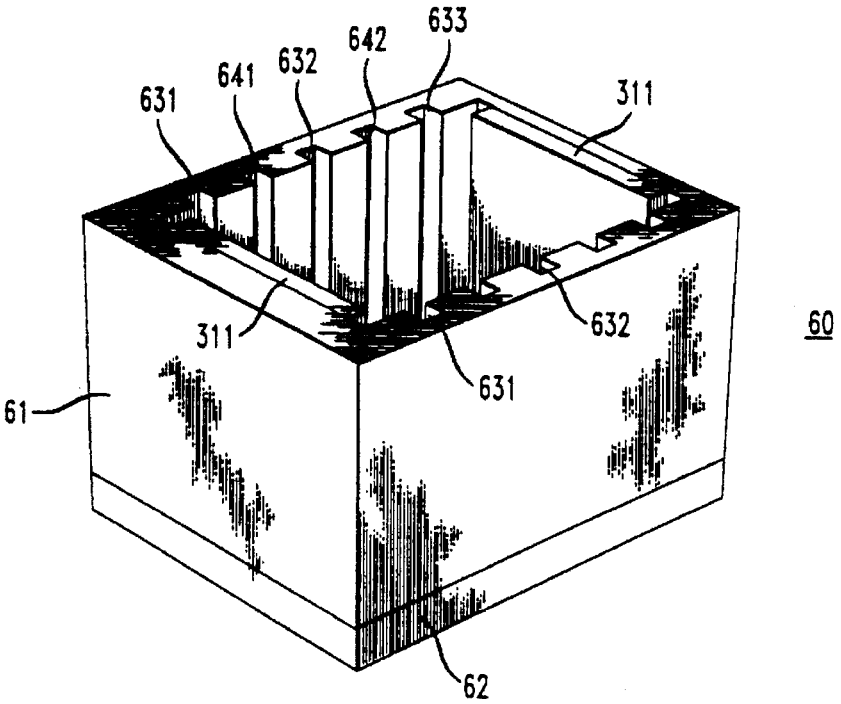

ELECTROMAGNETIC RESONATOR COMPRISED OF ANNULAR RESONANT BODIES DISPOSED BETWEEN CONFINEMENT PLATES

This invention was made in part with government support under cooperative agreement No. 70NANB3H1381 awarded by the Department of Commerce.

FIELD OF THE INVENTION

This invention pertains to resonator elements for use at RF and microwave frequencies, exemplarily resonators for use in a wireless communication system, and for RF and microwave filters that comprise such resonator elements.

BACKGROUND OF THE INVENTION

Electromagnetic resonators are used in many fields of science and technology, from magnetic resonance to radar, and many resonator designs are known. For instance, W. N. Hardy et al. *Review of Scientific Instruments*, Vol. 52 (2), p. 213 (1981), disclose a "split-ring" resonator that can be used in the frequency region 200–2000 MHz. See also M. Mehdizadeh et al., *IEEE Transactions on Microwave Theory and Techniques*, Vol. MTT-31 (12), p. 1059 (1983). Other exemplary prior art embodiments of split-ring resonators are shown in P. Jezek et al., *Microwaves & RF*, p. 132, June 1984, and J. R. Delayen et al., *IEEE Transactions on Magnetics*, Vol. MAG-17(1), p. 939 (1981).

A particular and commercially important use of resonator elements is in RF or microwave filters. For the sake of concreteness, the discussion below generally will be limited to elements used in filters, although the instant invention is not necessarily so limited. More specifically still, for the same reason the discussion below will be substantially in terms of such filters used in wireless communication systems. Examples of wireless communication systems are cellular telephone systems, personal communication systems and mobile radio systems.

Because of rapid growth of demand for wireless communication services, it is expected that the spectrum currently allocated and/or planned for, e.g., cellular communications in the US, will be saturated before the end of this decade. The growth in cellular communication has placed enormous pressure on communications technology to increase system capacity, i.e., to increase virtual channel density and enhance data transfer rates within the current frequency spectrum allocations. However, currently available filtering techniques typically will not be able to provide the level of filtering required for the desired closer channel spacings, due for instance to the relatively low quality factor (Q) of typical prior art resonators. Thus, filters with rapid roll off and low insertion loss are needed. Furthermore, filters that are more compact than analogous prior art devices would be highly desirable, due for instance to the typical requirement to provide equipment for many communications channels at a given installation, with the equipment for each channel typically comprising a filter both at the transmitter and at the receiver. A typical prior art 6-stage cavity RF filter for cellular radio can be as long as 20 inches, with a diameter of 11 inches, frequently making it difficult to accommodate many such filters at a given installation.

In view of the above recited facts, it is submitted that a resonator that can yield a compact filter that can have low insertion loss and rapid roll-off at frequencies relevant for wireless communications would be highly desirable. This application discloses such a resonator, and filters that utilize the resonator.

SUMMARY OF THE INVENTION

In a broad aspect the invention is embodied in a novel electromagnetic energy resonator, or assembly of resonators. The resonator comprises a first body that comprises conductive material (optionally superconductive material). The first body has an outer and an inner surface, with a slit extending between said outer and inner surfaces. Associated with the outer surface is an outer dimension R (exemplarily the outer radius), and associated with which first body is an axial direction and a dimension t in the axial direction. The resonator furthermore comprises means for coupling electromagnetic energy to the first body, and means for coupling such energy from the first body. The resonator is characterized in that the dimension t is the thickness of the first body, with t being less than R (desirably $t<0.5R$, even $<0.1R$). The resonator also comprises a first and a second substantially planar electromagnetic field confining plate (herein "confining plate" or "CP"), disposed such that said axial direction is substantially perpendicular to the CPs, with the first body disposed between the two CPs. The distance between the first body and the first and second CPs, respectively, is less than R, frequently less than 0.5R, and each of the CPs comprises conductive material extending over at least a substantial portion of the CP, typically including the portion of the CP that is directly opposite the first body. Such a resonator will herein be referred to as a "thin ring" (TR) resonator.

The first body and/or CPs can consist completely of metal (e.g., copper, aluminum, or silver-plated brass), or can comprise dielectric material (e.g., polymer material or ceramic, e.g., zirconia or magnesia) and conductive material, (e.g., copper, aluminum or silver). Use of superconductive material (preferably, but not necessarily high temperature superconductive material of nominal composition $YBa_2Cu_3O_7$) is contemplated. The superconducting material can be in bulk or thin film form, but frequently will be in form of a thick film. See, for instance, U.S. Pat. No. 5,272,132. Differentiation between "thick" and "thin" films is conventional and well understood by those skilled in the art.

TR resonators can be assembled into filters (to be referred to as "TR" filters), typically bandpass or notch filters, that are relatively compact. For instance, an exemplary 6-stage (superconducting) TR filter which runs at about 970 MHz measures slightly less than 4×4×8 inches. TR filters can be designed to operate at power levels of microwatts to many watts, and TR resonators can have high Q (exemplarily higher than 40,000 for a superconducting TR filter). Furthermore, TR resonators have a geometry that facilitates application of a superconducting layer to the relevant portions of the resonator, and that further facilitates contactless coupling of electromagnetic energy to and from the resonator as well as between resonators in a multi-resonator filter. Other potential advantages of TR resonators (and filters) include ease of tuning and the possibility of single mode operation, with attendant freedom from spurious modes.

TR resonators superficially resemble prior art "split-ring" or "loop-gap" resonators (see W. N. Hardy et al. op. cit.; M. Mehdizadeh et al., op. cit.), insofar as in both the prior art resonators and in TR resonators the slotted (first) body is associated with the induction, and the gap is associated with the capacitance of the resonant circuit. However, TR resonators differ from the prior art resonators in several important aspects. For instance, the former requires the presence of two planar conductive bodies (the confining plates) parallel and proximate to the thin ring. The latter typically does not comprise planar CPs, but typically comprises a tubular confining body concentric with the slotted body. Furthermore, in the TR resonator the slotted body has a thickness that is less than (typically much less than) the outer dimension R of the body, whereas in the prior art resonators the length of the slotted body frequently is larger than the outer dimension of the body.

BRIEF DESCRIPTION OF THE DRAWINGS

FIG. 5 shows, in exploded view, relevant aspects of an exemplary assembly of TR resonator elements;

FIG. 6 schematically depicts an exemplary housing for TR resonator elements;

No attempt has been made to represent objects to scale or in proportion.

DETAILED DESCRIPTION

Figure 1:
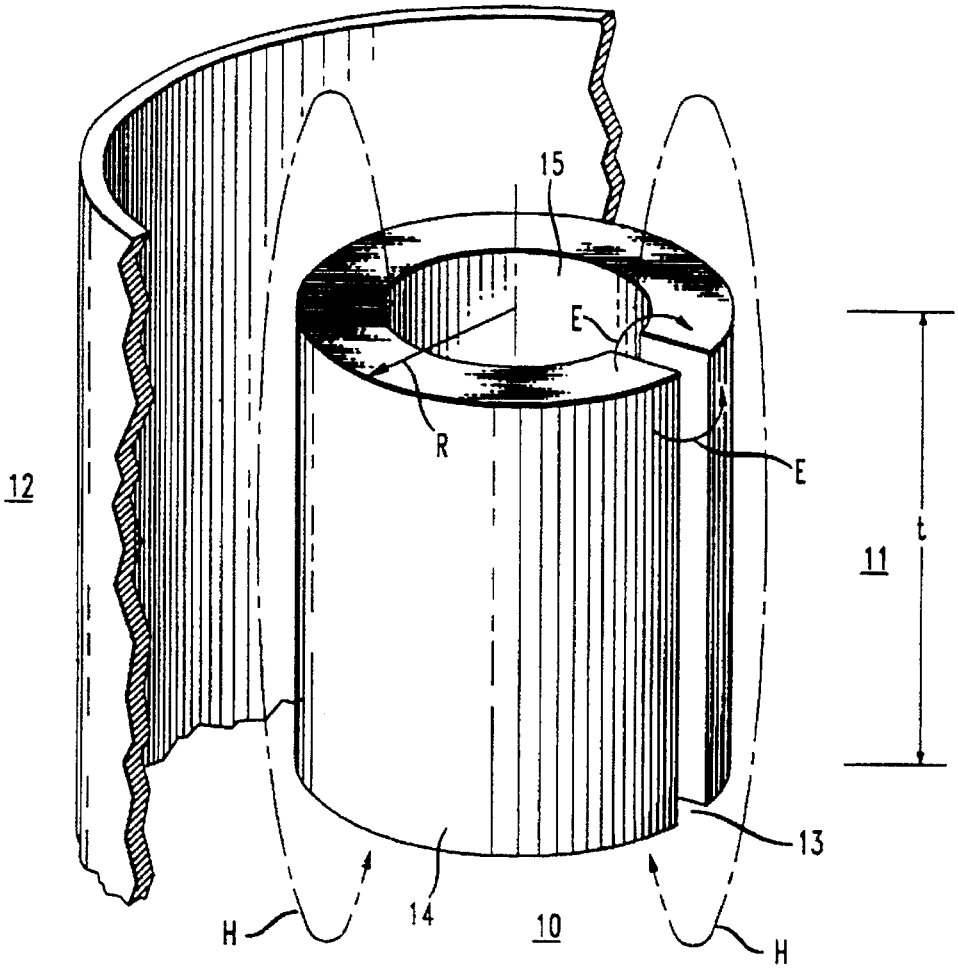
FIG. 1 (PRIOR ART)
FIG. 1 shows an exemplary prior art resonator.

FIG. 1 schematically depicts a prior art "loop-gap" resonator 10, wherein numeral 11 refers to the slotted (first) body, numeral 12 refers to the confining body, and numeral 13 to the slit that extends between outer surface 14 and inner surface 15. Variable "H" refers to magnetic field lines that are generated by a circumferential current on the slotted body, and variable "E" to electric field lines. Dimensions R and t are also indicated.

Those skilled in the art know that, in a loop-gap resonator as shown in FIG. 1, the image current on the confining body primarily flows on the inner surface of the cylindrical confining body, with relatively little current flowing in or on any optional planar portion of the confining body. (FIG. 1 of M. Mehdizadeh et al., op. cit., shows such an, electrically substantially non-functional, planar portion. Such planar portion is frequently absent or consists of dielectric material; see for instance, FIGS. 2, 3, 5, 6, 7, 8, 9 and 10 of M. Mehdizadeh et al.).

Figure 2:
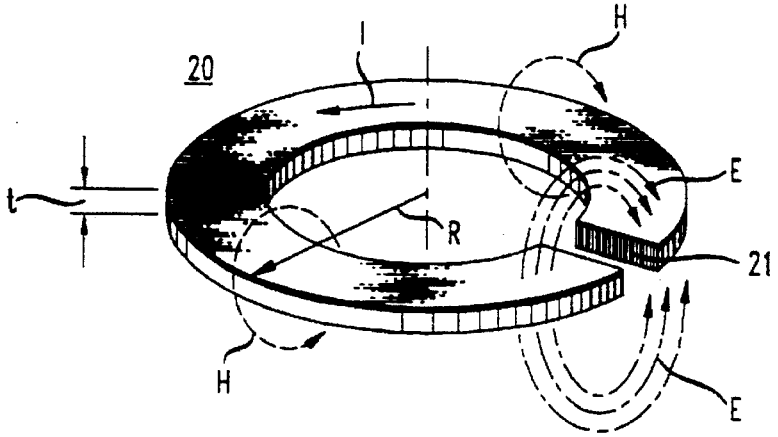
FIG. 2 depicts an exemplary first body, namely, a slotted thin ring.

FIG. 2 shows an exemplary first body 20 of a TR resonator, with arrow "T" indicating a circulating current which supports magnetic and electric fields H and E, respectively. Indicated are also the outer dimension R and the thickness t, with t being much less than R. Numeral 21 refers to the slot that extends between the inner and outer surfaces of the first body. Desirably the edges of the first body are rounded, inter alia to avoid undesirable current build-up and for ease of manufacture.

Figure 3:
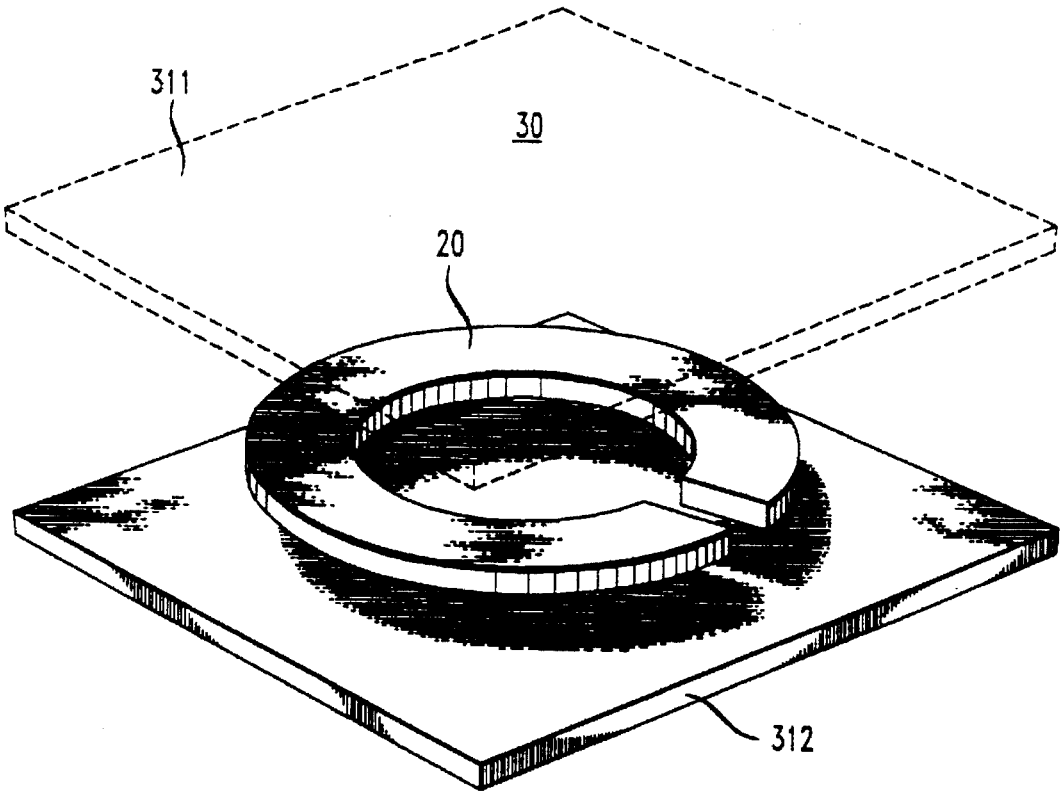
FIG. 3 schematically illustrates relevant aspects of a TR resonator, namely, a slotted thin ring disposed between two confining plates.

FIG. 3 schematically shows an exemplary TR resonator 30 that comprises first body 20 as well as confining plates 311 and 312. The first body is disposed between the CPs, typically equidistant from the first and second CP. Means for holding the first body as well as the CPs in the respective desired positions can be conventional and are not shown. For instance, at least in principle, conventional insulating material could be placed between the first body and the CPs to maintain the spacing between the three bodies. However, this approach typically is not preferred, since the presence of such dielectric material in many cases would result in degradation of resonator characteristics, e.g., result in reduced Q.

Means for coupling electromagnetic energy to and from the first body can be conventional and are not shown. The first body and/or the CPs can consist of conductive material, or exemplarily can comprise a highly conductive material layer on, e.g., dielectric material or a conductor of lower conductivity.

Figure 4:
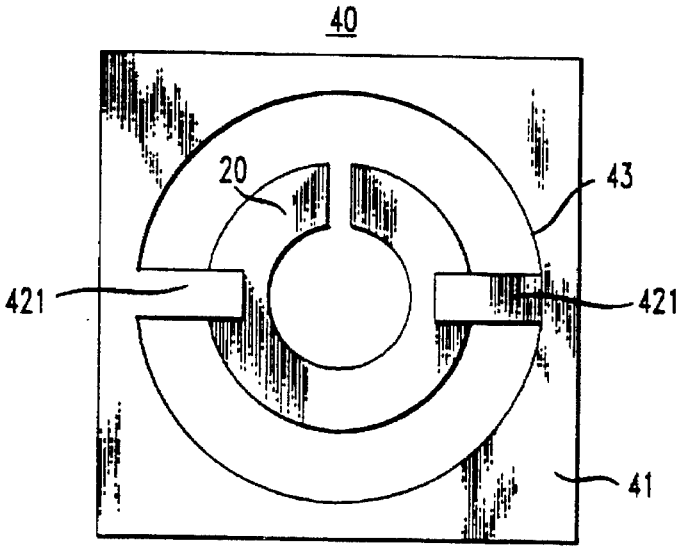
FIG. 4 schematically shows an exemplary assembly, namely, a slotted thin ring held by a support body.

FIG. 4 schematically depicts an assembly 40 that consists of first body 20 and support body 41. Body 41 typically consists of dielectric material, e.g., $Al_2O_3$, and exemplarily is a square sheet with substantially circular opening 43 therein. First body 20 is maintained in opening 43 by any appropriate means. Exemplarily the body is adhered to fingers 421, or the fingers are slotted, and the body fitted into the slots. In order to maintain a high Q it is desirable that contact with the first body is minimized.

FIG. 5 shows schematically relevant components of an exemplary three-stage TR filter. Intermediate CPs 51 contain openings 52 which facilitate coupling between adjacent first bodies 20. End CPs 311 do not comprise a coupling opening, but typically comprise means for coupling electromagnetic energy to and/or from the filter. Such means can be conventional and are not shown. For instance, an appropriately shaped (e.g., C-shaped or U-shaped) conductor body can be secured to the inward-facing surface of an end plate 311, with one end of the body electrically connected to the end plate. The other end of the body is electrically isolated from the end plate and is connected to the center conductor of a coaxial feeder line. A similar arrangement on the other end plate can serve to couple energy from the filter. Other coupling arrangements, including capacitive ones, are also contemplated. Exemplarily, a capacitor plate is placed in the vicinity of the slot of the end TR and connected to a feed line. Numeral 41 of FIG. 5 designates a support body of the type shown in FIG. 4 and designated by the same numeral.

FIG. 6 schematically depicts the relevant portion of an exemplary housing for a three-stage TR filter. The housing 60 comprises bottom plate 62, side walls 61, and end confining plates 311. The housing is adapted for receiving three assemblies 40 of the type shown in FIG. 4, one each in slots 631, 632 and 633, and two intermediate confining plates 51 of the type shown in FIG. 5, one each in slots 641 and 642. Typically the housing also comprises an appropriate cover (not shown), as well as means (also not shown) for coupling energy to and/or from the filter. Those skilled in the art will appreciate that housings substantially as shown in FIG. 6 can readily be adapted for filters of any desired number of stages.

Figure 7:
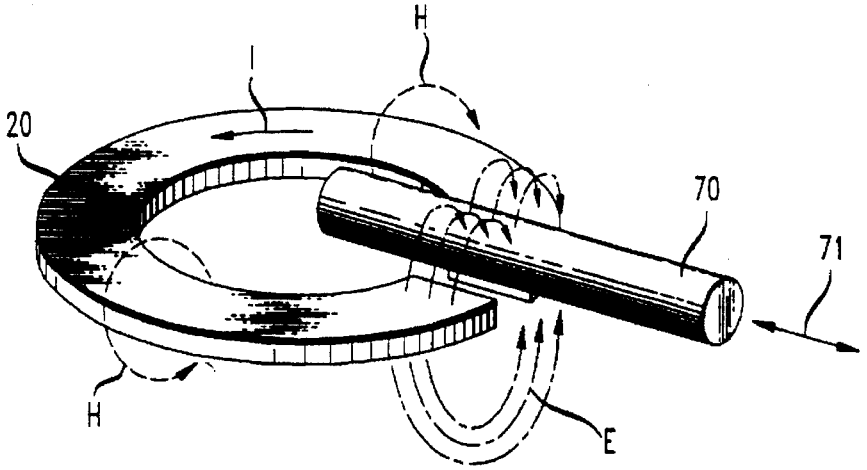
FIG. 7 schematically illustrates an exemplary technique for tuning of a TR resonator.

TR resonators can be readily tuned, exemplarily as depicted schematically in FIG. 7, wherein numeral 70 refers to a tuning rod, exemplarily a copper tuning rod that can be moved in the radial direction, as indicated by arrow 71. Letters I, E and H refer to current, electric field lines and magnetic field lines, respectively, as substantially described with regard to FIG. 2. As indicated in FIG. 7, the presence of the tuning rod results in distortion of the electric field E, and consequently in a change of the capacitance of the resonator. Those skilled in the art will appreciate that tuning also can be achieved by means other than a conductive tuning rod. For instance, a dielectric rod can be used, or the slot size could be changed physically. By way of further example, a metallic disc adjacent the gap may be provided, with tuning accomplished by moving the disc closer to or away from the gap. All such means are contemplated. The tuning means can be secured with respect to the associated TR resonator by conventional means, e.g., by attachment to a dielectric extension rod that extends through a bore in a wall of housing 60 of FIG. 6. Controlled radial adjustment is facilitated by means of a threaded extension rod and threaded bore.

If a multiplicity of TR resonators are assembled into a TR filter, it is typically desirable to provide tuning means for each of the assembled resonators, in order to facilitate optimal control over filter characteristics.

Figure 8:
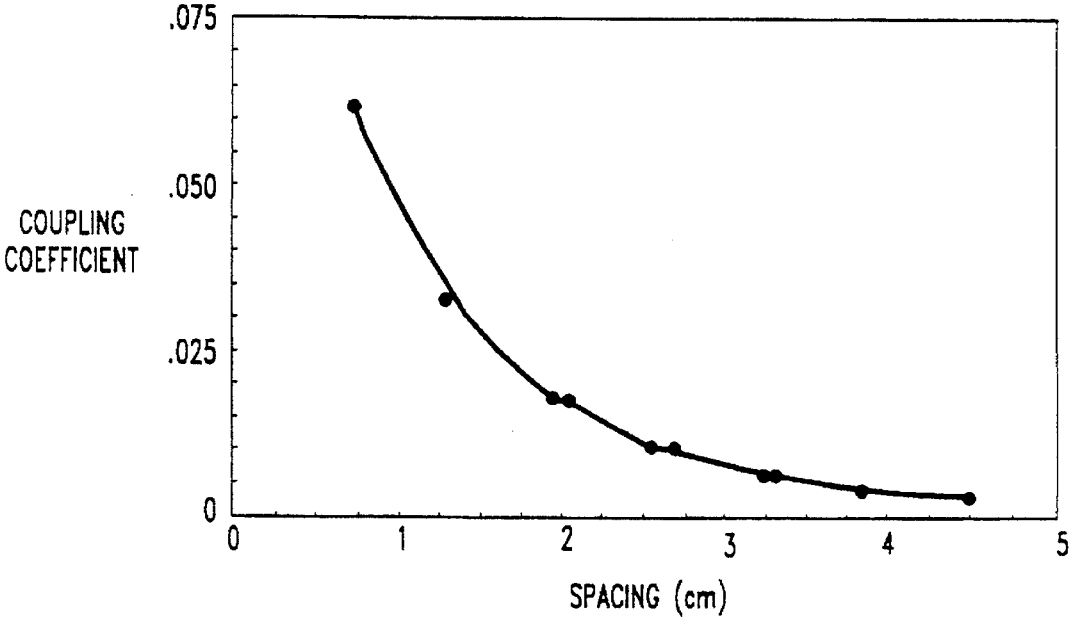
FIG. 8 shows exemplary data on the dependence of the coupling coefficient between two TR resonators on the distance between the resonators.

TR filters can be designed by a procedure that is substantially as used in the design of prior art filters. This procedure is well known to those skilled in the art and does not require detailed exposition. See, for instance, A. I. Zverev, "Handbook of Filter Synthesis", J. Wiley and Sons, Inc., New York, 1967. Briefly, the designer selects the desired filter response and filter type, and then determines the required number of resonators with the aid of known nomographs. Using known tables for the (normalized) conventional parameters k and q, the required values of quality factor Q and coupling coefficient K can be determined. Using a known de-tuning and adjusting procedure, the end resonators are set to the required Qs. From data of K as a function of distance between resonators, the spacing between the TR resonators that will yield the required K is determined. FIG. 8 shows such data for a TR resonator of the type shown in FIG. 3.

The first body and CPs of a TR resonator comprise conductor material, and typically consist of conductor material. This material can be conventional metal (e.g., Ag-coated copper, brass, aluminum, stainless steel, etc.), or it can be superconducting material, either in bulk form or as a coating on an appropriate core body, e.g., Ag-coated stainless steel, or Ag/Ni-coated copper. The material of the core body advantageously is selected to have a coefficient of expansion similar to that of the superconducting coating.

In a currently preferred embodiment the superconducting material is a "thick" film of Y-Ba-Cu-oxide comprising as a major constituent (typically consisting substantially of) material of nominal composition $YBa_2Cu_3O_7$ which imparts to the film superconducting properties (including essentially zero DC resistance) at 77K or at even higher temperatures. Preferably, the film is a textured film produced by melt-textured growth (see U.S. Pat. Nos. 5,011,823 and 5,157,017), most preferably produced by the low temperature technique disclosed in U.S. Pat. No. 5,340,797, incorporated herein by reference.

Briefly and exemplarily, the technique of the '797 patent comprises providing a stoichiometric mixture of $Y_2O_3$, CuO and $BaCO_3$ powder, making a precursor "paint" by combining the precursor powder mixture with an acrylic binder, a sorbitan trioleate dispersant and an n-butanol/xylene solvent. The precursor paint is then applied to an appropriate substrate (e.g., a Ag-coated stainless steel thin ring) by appropriate means, e.g., a brush, such that the resulting dried film is about 0.2 mm thick. The coated substrate is then placed into a controlled atmosphere furnace, heated in 2 Torr of $O_2$ at 60° C./hr to 350° C. to remove the organic components of the coating, followed by heating at a rate of 300° C./hr to 900° C. in 0.9% $CO_2$ in nitrogen. This in turn is followed by 1 hr at 900° C. in 2 Torr of oxygen, with subsequent slow cooling in oxygen. This process can produce a textured superconducting film of $YBa_2Cu_3O_{7-x}$ (x~0).

An advantage of embodiments of the instant invention is their potentially relatively small size, compared to analogous prior art resonators and filters. In order to attain particularly small size it will frequently be desirable to place an appropriate capacitance-increasing material into the slot of the thin ring, exemplarily as shown schematically in front view in FIG. 9, wherein numeral 90 refers to a gap-filling dielectric body. Desirably, body 90 consists of material having large dielectric constant (greater than 10, preferably greater than 100 or even 1000) and small loss tangent (preferably less than $10^{-4}$) at the relevant frequency (e.g., about 1 GHz) and the desired operating temperature.

To the best of our knowledge there is no a priori reason why a dielectric material that meets the above referred to stringent criteria (dielectric constant$\gtrsim$1000, loss tangent$\lesssim 10^{-4}$) at liquid nitrogen temperatures should exist. However, we have found materials that can meet the criteria. These include $SrTiO_3$, $KTaO_3$, and possibly mixed dielectrics based on these compounds. Thus, some preferred embodiments of the invention will comprise gap-filling material to increase the capacitance of TR resonators that operate at liquid nitrogen temperatures, said gap-filling material comprising $SrTiO_3$ and/or $KTaO_3$.

Figure 10:
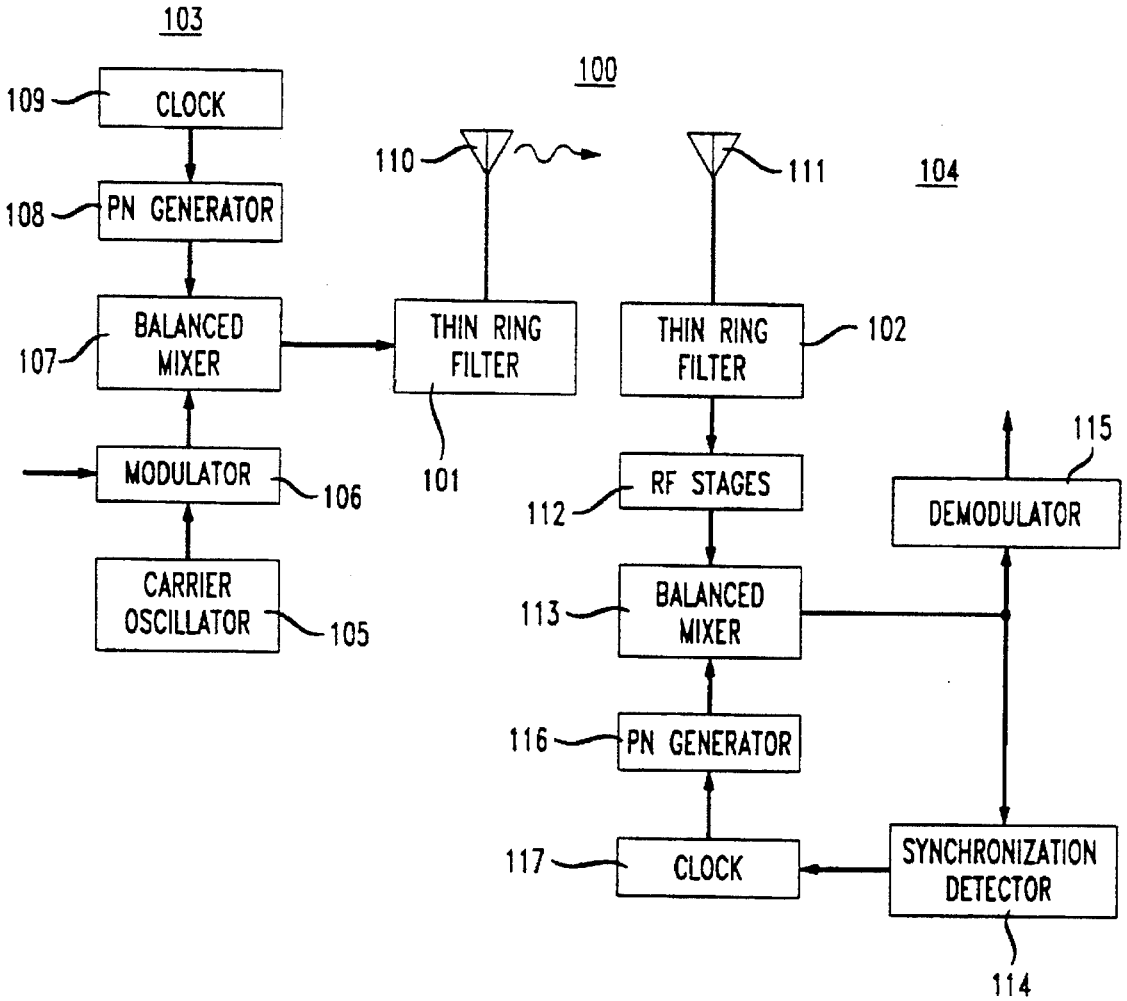
FIG. 10 schematically shows the major components of a wireless communication system.

FIG. 10 schematically depicts a communication system 100 that may be used with the present invention. The system comprises TR filters 101 and 102 in, respectively, transmitter section 103 and receiver section 104. The remaining components of the system (e.g., carrier oscillator 105, modulator 106, balanced mixer 107, pseudo random noise (PN) generator 108, clock 109, transmitter antenna 110, receiver antenna 111, RF stages 112, balanced mixer 113, synchronization detector 114, demodulator 115, PN generator 116, and clock 117) can be conventional.

EXAMPLE

A 3-pole filter was manufactured as follows. Three copper split rings were provided. The rings were substantially as shown in FIG. 2, with 2R=1.900 inches, inner diameter of 1.450 inches, gap width 0.090 inches, and thickness of 0.080 inches. All edges were rounded. A layer of silver was applied to each ring by electroplating, followed by application of a layer of Y-Ba-Cu-oxide superconductor in a manner substantially as described in U.S. Pat. No. 5,340,797. The superconductor layer covered essentially all of the split ring surfaces, and was superconducting at 77K.

Figure 9:
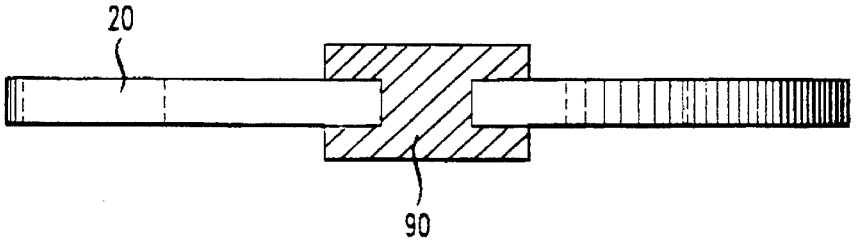
FIG. 9 schematically depicts a split ring with capacitance-increasing dielectric material.
Figure 11:
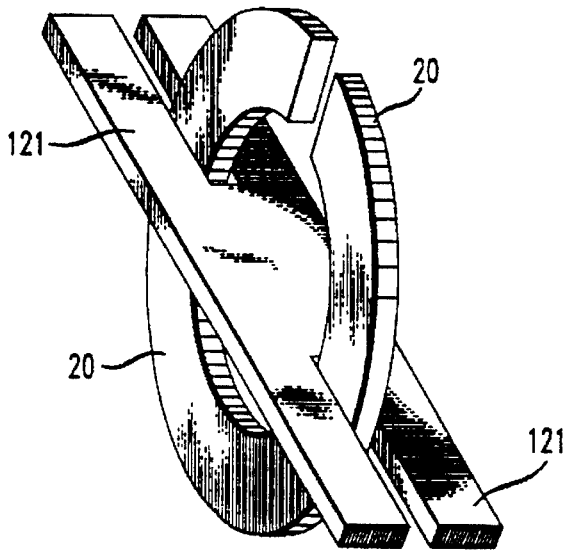
FIG. 11 shows an exemplary ring support plate/ring assembly.

Three 0.035 inches thick rectangular (2.9350×0.8630 inches) alumina ring support plates were provided. Each plate comprised two 0.0900 inch wide slots that extended 0.7300 inches from the narrow sides of the plate towards the center thereof. Into the slots of each of the alumina plates was inserted one of the split rings such that the plane of the ring was substantially perpendicular to the plane of the plate, substantially as shown in FIG. 11, wherein numeral 121 designates the ring support plate. In FIGS. 7, 9 and 11, reference numeral 20 designates a first body of the type shown in FIG. 2 and designated with the same reference numeral.

Four quadratic (3.200×3.200 inches) OFHC copper CP plates, of thickness 0.125 inches, were provided. Each plate comprised tongues that extended around the periphery of the plate. Two of the CP plates had a central circular aperture.

A OFHC copper housing was provided. The housing was substantially as shown in FIG. 6, but slots were provided to receive the end CPs, and no slots were provided to receive the three split rings. The slots were shaped to receive the lips of the CPs. Furthermore, the housing side walls comprised copper "shelves" that served to support the alumina ring support plates with the split rings therein. The base plate comprised two through-apertures that facilitate coupling of electromagnetic energy into and from the filter. The outer conductor of a substantially rigid coaxial cable was electrically connected to the housing, and the inner conductor was soldered to an end of a strip of copper foil. The strip was bent into basically U-shape (with legs much shorter than the base), with the other end of the strip being electrically isolated from the housing. The resulting coupling loops were positioned between the respective end CPs and the outer split rings. In addition to bottom, two end walls and two side walls, the housing also comprised a OFHC copper lid. Three threaded-through holes were provided to receive threaded copper rods, with a silver-plated copper disc soldered to the end of each threaded rod. Each disc could be moved towards and away from the gap in one of the split rings, thereby facilitating tuning of the resonator.

After placement of the three split rings and four CPs into the housing, assembly of coupling means and tuning means, and completion of the assembly by attachment of the lid, the resonators were tuned by a conventional procedure. After completion of tuning the filter assembly was placed in liquid nitrogen, and the electrical properties of the filter were measured.

Figure 12:
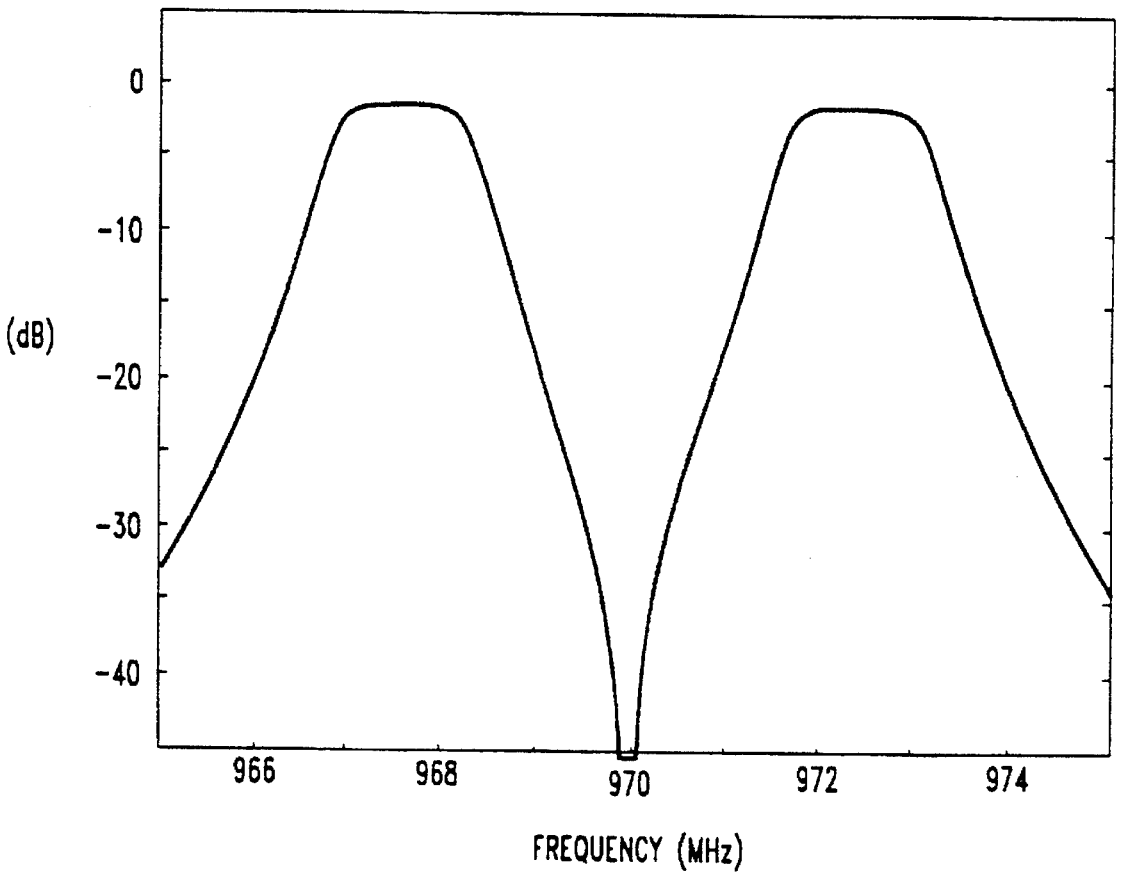
FIG. 12 shows electrical characteristics for an exemplary dual frequency bandpass filter according to the invention.

FIG. 12 shows electrical characteristics of a dual frequency bandpass filter comprising two 4-stage filters substantially as described above, tuned to frequencies of 967.5 MHz and 972.5 MHz, respectively. Each respective filter was fed through a quarter-wave coupling line, and the filters were maintained at 77K.

Figure 13:
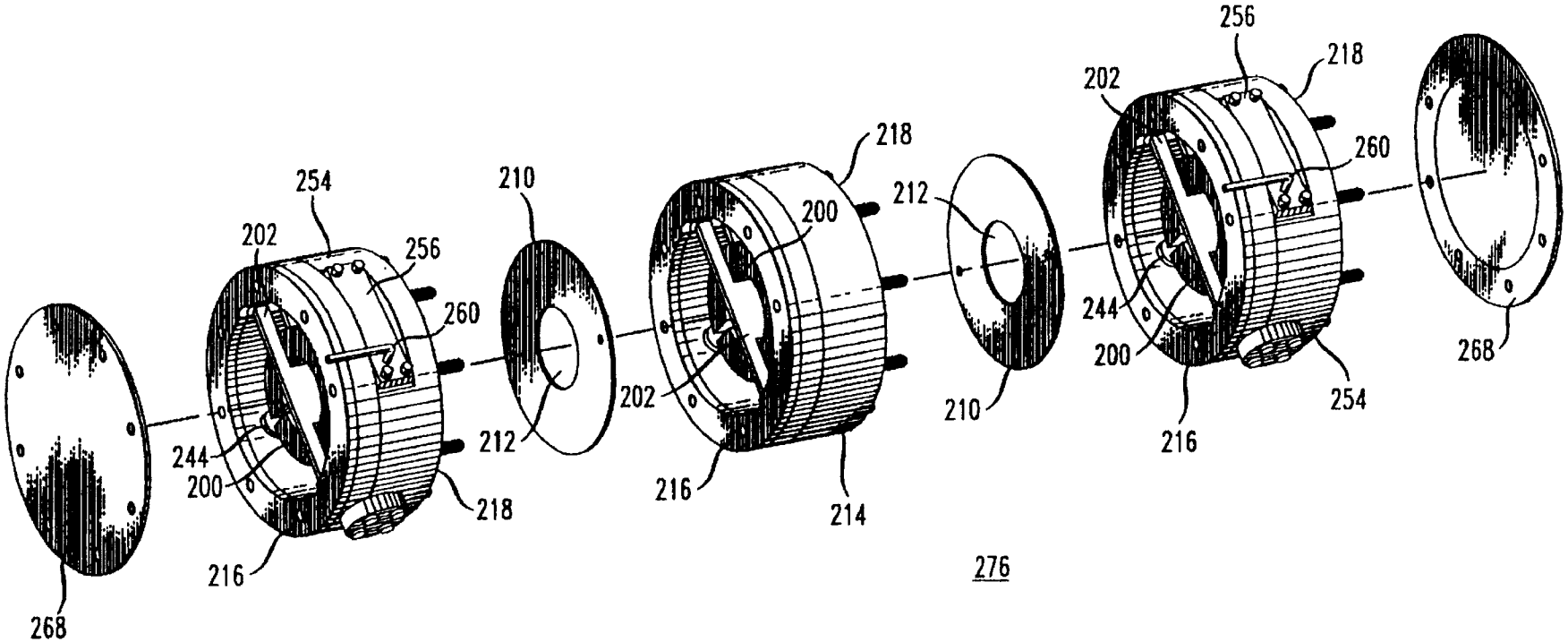
FIG. 13 shows a further embodiment of the invention in exploded view.

FIG. 13 shows, in exploded view, a further exemplary embodiment of a filter according to the invention. Modular filter 276 has a housing made of three cells (interior cell 214 and two end cells 254), but could comprise more cells. Each cell contains a TR resonator 200 secured to the respective cell by a substrate 202. When the modular filter is assembled, an electromagnetic signal can be transmitted through coaxial connector 260 into bushing 256 for coupling to the resonator in the respective end cell. The signal is then coupled through coupling plates 210 to the other resonators and is available at the other coaxial connector 260. In FIG. 13, numerals 212 refer to apertures in the coupling plates, numerals 216 and 218 refer to upper and lower surfaces of the respective housings, and numerals 268 refer to end plates.

Once filter 276 has been assembled, tuning discs 244 can be adjusted by conventional means (not shown) to tune the resonators to the desired filtering characteristics, as is well known in the art. If the resonators 200 comprise superconducting material, then the filter exemplarily will be immersed in an appropriate cooling medium (e.g., liquid nitrogen) after all adjustments have been made, or may be placed in a cryorefrigerator such as the CRYOTIGER® manufactured by APD cryogenics of Allentown, Pa.

Filter 276 is designed to be easily sealed so that the cooling medium does not enter the interior of the filter, while still permitting detachment of cells for service or addition of cells. Sealing is facilitated by means of appropriate gaskets, e.g., indium gaskets. Such gaskets are well known in the art. The cells, coupling plates and end plates of the filter may be made of a variety of electrically conductive materials, but preferably are made of silver-plated aluminum.

Although only three cells are shown for modular filter 276, more cells may be added to modify the filter characteristics as desired, as is well known in the art. Adding cells is accomplished by inserting additional interior cells 214 having resonators 200 into the middle of the filter once cells have been separated from each other. Superconducting resonators which may be used in the modular filter 276 have very low insertion loss and therefore a number or resonators can be used in a given filter without unacceptably weakening the output signal. One significant advantage of the modular filter 276 is the ease with which additional resonators can be added to obtain the desired filter characteristics.

We claim:

1. An article comprising a resonator for electromagnetic energy comprising a) two or more essentially identical annular bodies, a given one of the annular bodies having a thickness t and radial dimension R relative to an axis of the body, said body comprising conductive material and having an outer surface and an inner surface, with a slit extending between said outer and inner surfaces, each of said outer and inner surfaces being substantially parallel with the axis of the given body, said thickness t is aligned along the axial direction and is less than the radial dimension R, said two or more annular bodies being coaxially disposed;

b) substantially planar end confinement plates for electromagnetic energy, said two or more annular bodies disposed between and spaced from said, end confinement plates;

c) at least one substantially planar intermediate confinement plate disposed between, and spaced from, two of said two or more annular bodies, said intermediate confinement plate having an opening that facilitates coupling electromagnetic energy between said two adjacent ones of the two or more of the annular bodies, wherein each of said end confinement plates and intermediate confinement plate is disposed such that the axis of the given one of the annular bodies is substantially perpendicular to any of the confinement plates; and d) means for coupling electromagnetic energy to the resonator, and means for coupling electromagnetic energy from the resonator.

2. An article according to claim 1, wherein t is less than 0.5R.

3. An article according to claim 2, wherein t is less than 0.1R.

4. An article according to claim 1, wherein said slit is at least partially filled with dielectric material having a dielectric constant of 1000 or greater and a loss tangent of $10^{-4}$ or less at a temperature of 77K and a frequency of 1 GHz.

5. An article according to claim 4, wherein said dielectric material comprises material selected from the group consisting of $SrTiO_3$ and $KTaO_3$.

6. An article according to claim 1, wherein the given annular body comprises superconductive material.

7. An article according to claim 6, wherein the superconductive material exhibits essentially zero DC resistance at a temperature of 77K.

8. An article according to claim 7, wherein the superconductive material comprises $YBa_2Cu_3O_x$, with x~7.

9. An article according to claim 6, wherein the given annular body further comprises a core body, said core body comprising material selected from the group consisting of copper, stainless steel, silver, nickel, zirconia and magnesia, with the superconductive material substantially covering said core body.

10. An article according to claim 1, wherein each of said two or more annular bodies comprises a core body that is substantially covered with a superconductive material that exhibits essentially zero DC resistance at a temperature of 77K, each of said core bodies comprising material selected from the group consisting of copper, silver, stainless steel, nickel, zirconia and magnesia.

11. An article according to claim 10, further comprising means for cooling said first body and said further body to a temperature at which said superconductive material exhibits substantially zero DC resistance.

* * * * *